United States Patent [19]

Plough

[11] 3,972,501

[45] Aug. 3, 1976

[54] SPREADER BAR ASSEMBLY FOR A CONCRETE WALL FORM

[75] Inventor: Russell H. Plough, Chicago, Ill.

[73] Assignee: Symons Corporation, Des Plaines, Ill.

[22] Filed: Jan. 27, 1975

[21] Appl. No.: 544,281

[52] U.S. Cl. ..... 249/42; 249/217

[51] Int. Cl.[2] ..... E04G 17/08

[58] Field of Search ..... 249/40–42, 249/46, 190, 213–214, 216–217, 219 W

[56] References Cited

UNITED STATES PATENTS

| | | | |
|---|---|---|---|
| 2,069,085 | 1/1937 | Day | 249/42 |
| 2,074,460 | 3/1937 | Colt | 249/213 |
| 2,116,597 | 5/1938 | Colt | 249/42 |
| 2,164,592 | 7/1939 | Pilj | 249/42 |
| 2,659,125 | 11/1953 | Williams | 249/42 |
| 3,357,672 | 12/1967 | Capek | 249/216 |
| 3,767,158 | 10/1973 | Mikus | 249/40 |

OTHER PUBLICATIONS

"Versiform System," Catalog No. AV–2 of Symons Corp.; p. 4; Published 1973.

"Vertical Forming Systems," Symons Corp. 73–73 Catalog; p. 19, Published 1973.

*Primary Examiner*—Francis S. Husar
*Assistant Examiner*—John McQuade
*Attorney, Agent, or Firm*—Norman H. Gerlach

[57] ABSTRACT

A spreader bar assembly which is designed for use in a concrete wall form and cooperates with a she-bolt on one end of a tie rod in preventing inward collapse of the adjacent side of the form prior to pouring of wet concrete between the opposed form sides. A washer which is loosely and telescopically received over the she-bolt bears against the outer side of the adjacent form side and is clamped thereto by a nut, while a pivoted spreader bar proper which is captured on the washer is capable of swinging movement in a vertical plane between a locking position wherein it passes across the front or outer face of the nut and assimilates any tendency for inward collapse of the adjacent form side, and an out-of-the-way position wherein it exposes the nut for manipulating purposes.

4 Claims, 4 Drawing Figures

SPREADER BAR ASSEMBLY FOR A CONCRETE WALL FORM

The present invention relates generally to a concrete wall form and has particular reference to that type of form which consists of opposed, vertically extending spaced apart form sides, each of which embodies a series of rectangular plywood or other panels arranged in edge-to-edge relationship and reinforced by horizontal walers or vertical strongbacks or both, walers alers or strongbacks bridging the entire width or height of the form sides on the outer sides of the latter, with opposed walers or strongbacks on opposite sides of the form being connected together by horizontally extending tie rods which have she-bolts at their outer ends and serve to assimilate the outward reaction thrust of the wet concrete which is poured between the form sides in connection with the formation of a concrete wall.

Heretofore it has been customary to employ vertical strongbacks which consist of pairs of metallic channel members which are slightly spaced apart and between which the she-bolts project, cast metal washers being loosely received over the outer ends of the she-bolts and held in position by fastening nuts which are threadedly received on the she-bolts, the washers bridging the distance between the pairs of channel members of the strongbacks, bearing against the outer sides of the channel members, and the nuts, when properly and accurately received on the she-bolts, absorbing the reaction thrust of the poured concrete and serving to maintain the form sides in their proper vertical positions. However, prior to pouring of the concrete between the forms, it is necessary to afford suitable means for preventing inward displacement or collapse of the form sides due to the fact that the fastening nuts are capable only of assimilating an outward thrust on such form sides but are incapable of preventing inward shifting movement of the form sides.

One relatively simple means for thus holding the form sides erect and against inward displacement or collapse consists in the use of metal members of U-shape configuration (commonly referred to as spreader clips), such members being of rigid one-piece construction and having flat parallel side flanges or legs and flat connecting webs or bight portions. After the form sides have been assembled and erected in their spaced apart relationship with the she-bolts projecting through and between the adjacent pairs of channel members of the vertical strongbacks and with the washers and their associated fastening nuts applied, one of the spreader clips is caused by a manual operation to be applied to each washer and nut by the simple expedient of placing the same in straddling relationship over the washer and nut with the inside face of one leg opposing the nut and the other leg opposing the inside face of the washer. The washer is bolted to the adjacent strongback and, thus, the spreader clip maintains the associated washer and nut in close proximity to each other so that if there is a tendency for the adjacent form side to collapse inwardly, the washer which holds the associated strongback anchored thereto is unable to move away from the nut to any appreciable extent and, hence, said adjacent form side is maintained substantially erect and vertical during concrete-pouring operations which then force the form side outwardly against the reaction thrust of the nut. After the concrete has hardened and it is desired to dismantle the form, the spreader clips may be manually pulled from their locking position so that access may be had to the nuts for loosening purposes, the clips being separate and unitary structures. Examples of such spreader clips are disclosed on page 4 of Catalog No. AV-2 of Symons Corporation of Des Plaines, Illinois, published in 1973, and entitled "VERSIFORM SYSTEM," and also on page 19 of said Symons Corporation's 73—73 catalog published in 1973, and entitled "VERTICAL FORMING SYSTEMS."

Spreader clips of the character set forth above are possessed of certain limitations, principal among which is the fact that they are loose items which easily become misplaced so that a workman, during erection of a given concrete wall form, is obliged to carry with him a supply of such clips. Also, at the time of concrete form dismantling operations, the workman must keep track of or provide a special place for such clips. Furthermore, during actual clip application of the associated washer and nut assembly, care must be taken in order to effect the application in a proper manner, each clip being fitted in place, so to speak, by the operator. The present invention obviates these difficulties by providing a captured spreader bar assembly which is intimately associated with and pivoted to the associated washer and which, after the washer has been operatively clamped in position on the adjacent strongback, walers or other panel-reinforcing members, is capable of being swung to an out-of-the-way position where it does not interfere with application of the associated fastening nut to the threaded she-bolt, and then, after the nut has been applied and tightened to the desired degree, may be flipped by a simple manual operation to its operative position wherein it closely overlies the front face of the nut and binds the washer to the nut so that the former may not travel inwards of the adjacent wall form side, carrying with it the associated strongback and, consequently, the entire adjacent form side and the latter is thus held substantially vertically erect until after concrete-pouring operations have been completed.

The provision of a spreader bar assembly such as has briefly been outlined above, and possessing the stated advantages, constitutes the principal object of the present invention.

Other objects and advantages of the invention, not at this time enumerated, will readily suggest themselves as the nature of the invention is better understood from a consideration of the following detailed description.

The invention consists in the several novel features which are hereinafter set forth and are more particularly defined by the claims at the conclusion hereof.

In the accompanying two sheets of drawings forming a part of this specification, one illustrative embodiment of the invention is shown.

Figure 1:
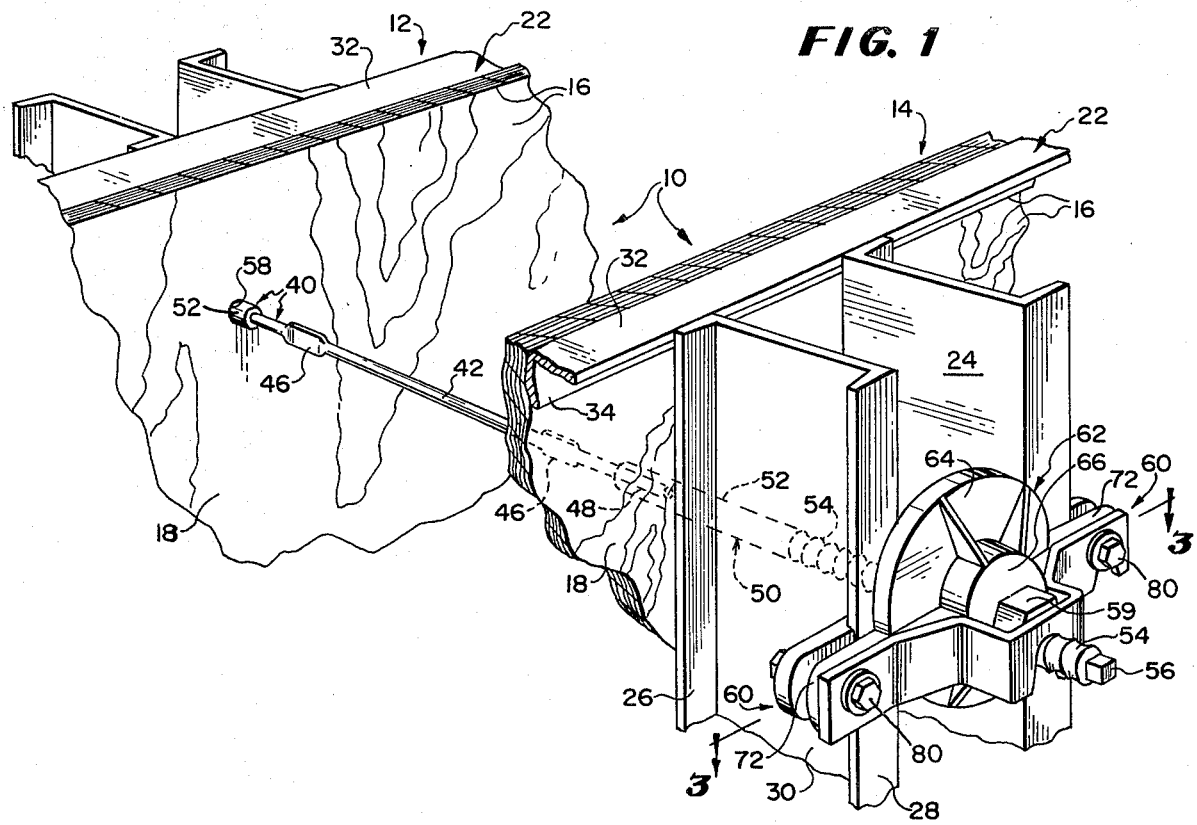
FIG. 1 is a fragmentary perspective view, partly in section, of a concrete wall form showing the improved spreader bar assembly of the present invention operatively applied thereto.

Referring now to the drawings in detail and in particular to FIG. 1, a fragmentary portion of a composite concrete wall form of conventional construction is illustrated therein and designated in its entirety by the reference numeral 10. The wall form is made up of two opposed, vertically extending, spaced apart sides 12 and 14, each of which consists of a series of rectangular panel units 16. It will be understood that although only one panel unit 16 on each side of the wall form is disclosed herein, each of the two form sides 12 and 14 is made up of a plurality of such units with the adjacent units of each series being arranged in edge-to-edge relationship.

The panel units 16 may be of any conventional construction, the particular units selected for illustration herein consisting of rectangular plywood facings 18 which are bounded and reinforced by rectangular marginal steel frames, the latter including horizontal top and bottom frame members and vertical side frame members, only the top frame members 22 of each panel unit 16 being disclosed in the accompanying drawings. If desired, other forms of panel units, such as "Steel-Ply" panel units of the type which is manufactured and sold by Symons Corporation of Des Plaines, Ill., may be employed. Alternatively, all wood panel units are capable of being used. Irrespective, however, of the particular type of panel units which are employed, the essential features of the present spreader bar assembly remain substantially the same.

As is customary with a wide variety of concrete wall forms having opposed series of panel units such as the units 16, vertical strongbacks 24 are suitably secured to and are employed for reinforcing and aligning the panel units 16 of each of the form sides 12 and 14, such strongbacks being each in the form of a pair of slightly spaced apart, shallow, vertically elongated channel members having inner and outer outwardly extending short parallel side flanges 26 and 28 and interconnecting web portions 30.

In the illustrated form of panel unit 16, the top frame member 22 is in the form of an anglepiece having a horizontal, outwardly extending flange 32 and a vertical, downwardly extending flange 34, and it will be understood that the horizontal bottom and vertical side frame members will be of similar anglepiece construction. Insofar as the vertical strongbacks 24 are concerned, the inner side flanges 26 of the channel members thereof bear inwardly against the horizontal flanges 32 of the top frame members 22.

A plurality of conventional horizontally extending tie rod and she-bolt assemblies 40 is employed for maintaining the panel units 16 of the two form sides 12 and 14 of the concrete wall form 10 in their spaced apart relationship, each of these assemblies in the illustrated environment of the present spreader bar assembly being in the form of a medial or intermediate tie rod 42 and a pair of identical associated outer she-bolts 50. The tie rod 42 of each tie rod and she-bolt assembly 40 is provided with the usual flattened breakbacks 46, while the opposite ends thereof embody external screw threads 48 (see FIG. 2). Each she-bolt 50 comprises an inner cylindrical section 52 having an internally-threaded socket at its inner end and an outer, externally-threaded section 54, the latter having a squared wrench-receiving outer end 56 by means of which torque may be applied to the she-bolt for tightening purposes in the usual manner of tie rod tensioning. The internally-threaded adjacent panel at the inner end of the she-bolt is in screw-threaded engagement with the external screw thread 48 on the adjacent end of the associated tie rod 42. Each she-bolt 50 extends between the channel members of one of the strongbacks 24 and passes through a small opening or hole 58 (see FIG. 1) which is formed in the plywood facing 18 of the adjacentpanel unit 16. A clamping nut 59 is received over the outer end region of the outer threaded section 54 of each she-bolt 50 and cooperates with a novel spreader bar assembly which constitutes the principal adjacent panel of the invention and is designated in its entirety in the drawings by the reference numeral 60.

The arrangement of parts thus far described is purely conventional and no claim is made herein to any novelty associated with the same, the novelty of the present invention residing rather in the nature and construction of the novel spreader bar assembly 60 which not only absorbs the reaction pull of the illustrated tie rod and she-bolt assembly 40 when the nuts 59 are tightened, but which also prevents inward collapse of the adjacent form side during installation of the concrete form 10 before the tie rod of the said assembly 40 is tensioned and the wet concrete poured between the form sides 12 and 14. Whereas only one spreader bar assembly 60 is illustrated in the drawings and will be described in detail hereafter, it is to be understood that there will be one spreader bar assembly for each she-bolt 50.

Figure 2:
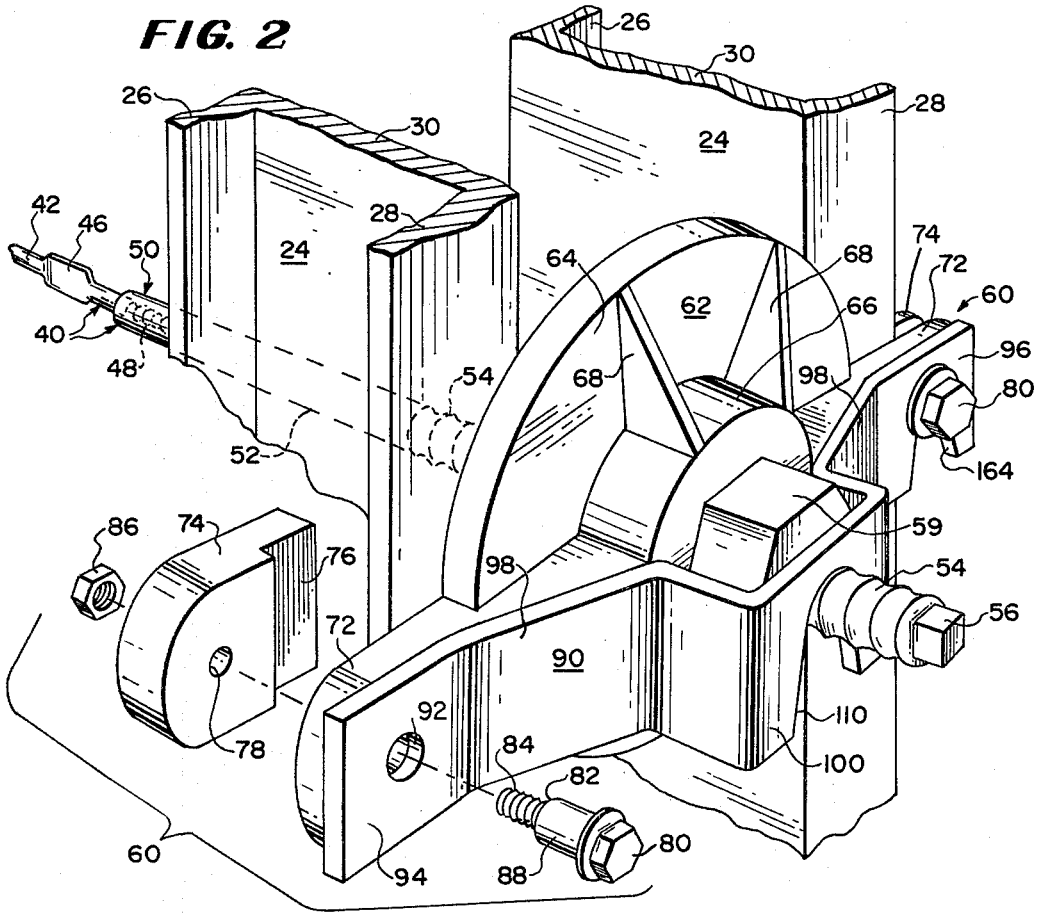
FIG. 2 is an enlarged, partially exploded fragmentary perspective view of the spreader bar assembly, showing the same in its operative position.
Figure 3:
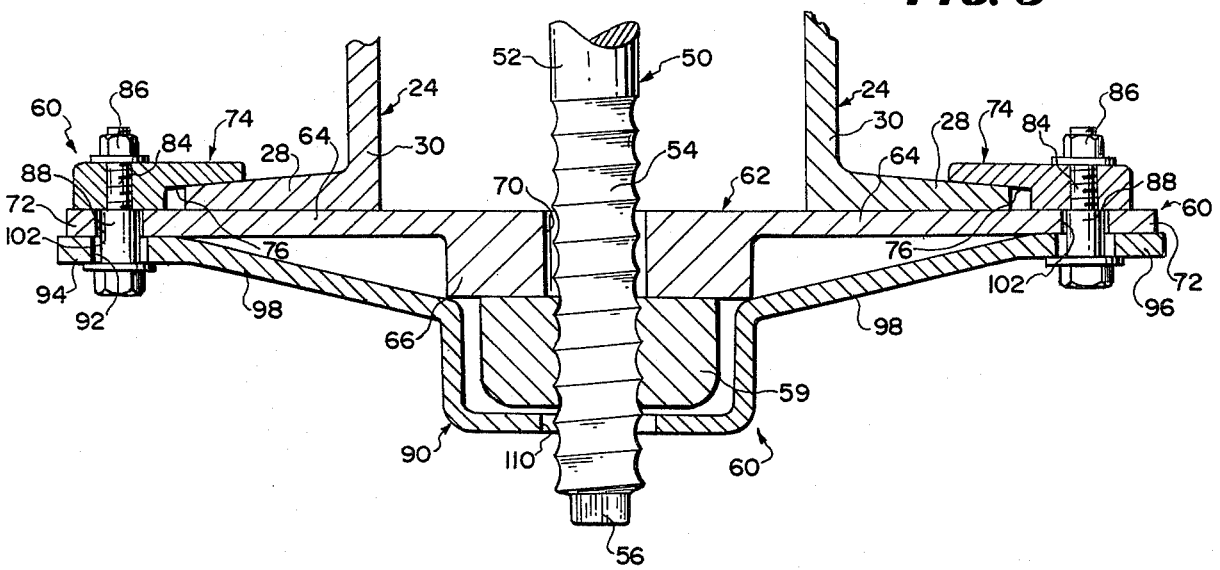
FIG. 3 is an enlarged sectional view taken on the horizontal plane indicated by the line 3—3 of FIG. 1 and in the direction of the arrows.
Figure 4:
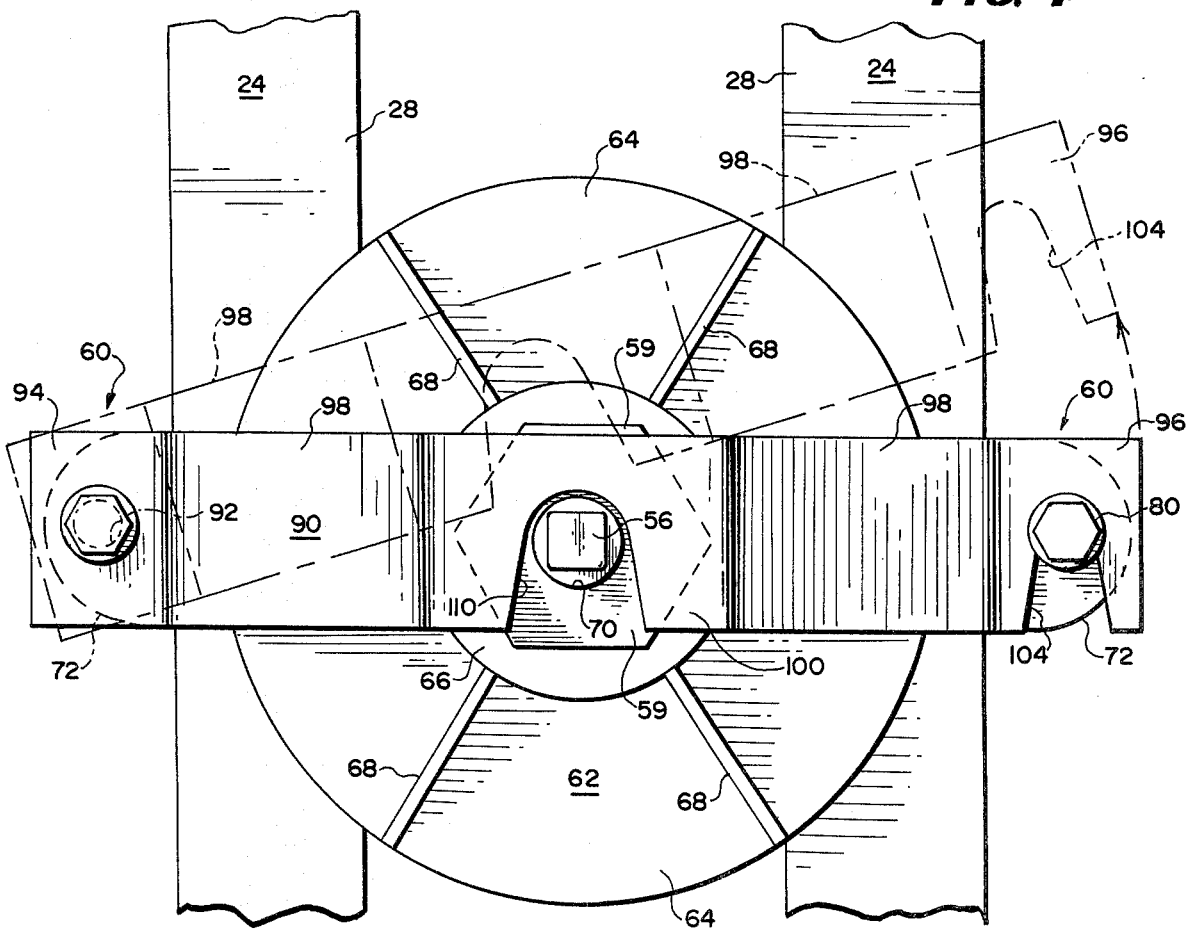
FIG. 4 is an enlarged front elevational view of the spreader bar assembly, such view showing the assembly in its locking or operative position on the wall form and also showing the spreader bar per se in broken lines in its position of release.

Still referring to FIGS. 1 and 2, and additionally to FIGS. 3 and 4, the function of the improved spreader bar assembly 60 is to absorb the reaction thrust of the associated tie rod and she-bolt assembly 40 when the nut 59 which is threadedly received on the outer threaded section 54 of the adjacent she-bolt 50 is tightened. This spreader bar assembly 60 involves in its general organization a generally circular reaction washer 62 which is preferably in the form of a metal casting and embodies a relatively flat circular body 64 from which there projects outwardly a cylindrical, centrally disposed hub 66. Triangular, radially extending, gusset-like webs 68 extend between the hub 66 and the outer side face of the body 64 for serving to reinforce the washer 62 as a whole. The hub and the body portion are formed with a central bore 70 (see FIG. 3) through which the outer threaded section 54 of the adjacent she-bolt 50 extends. The washer 62 spans the distance between the two vertical channel members of the associated strongback 24 and bears inwardly against the two outer flanges 28 of said members as clearly shown in FIGS. 1, 2 and 4 under the tightening force of the nut 59.

At diametrically opposite regions on the periphery of the body 64 of the washer 62 there is provided a pair of oppositely or outwardly extending radial clamping ears 72 which overhang the outer edges of the outer side flanges 28 of the channel members of the associated strongbacks 24 and cooperate with clamping blocks 74 and nut and bolt assemblies in fixedly securing the washer 62 to the associated strongback 24. Each of the two clamping blocks 74 is formed in the outer portion of its inner end with a recessed portion 76 (see FIG. 2) within which seats the adjacent side edge portion of the outer flange 28 of the adjacent channel member of the associated strongback 24. In addition, it is formed with a horizontal bore 78 therethrough. Each of the aforementioned nut and bolt assemblies includes a bolt 80 the shank of which embodies an annular shoulder 82 which seats against the outer face of the associated clamping block 74, and also an inner threaded end section 84 which projects loosely through the bore 78 and receives a clamping nut 86 on its outer extremity. When the nut 86 is tightened with respect to the bolt 80, it and the shoulder 82 thus serve fixedly to clamp the block 74 and the adjacent ear 72 of the washer 62 against the outer side flange 28 of the adjacent channel member of the associated strongback 24. The bolt 80 is provided between the annular shoulder 82 and its head with a cylindrical section 88 which loosely receives thereover one end region of an elongated spreader bar proper 90, a suitable hole 92 being formed in such end region of the bar for reception therethrough of said cylindrical section 88 of the bolt 80. The spreader bar 90 of the spreader bar assembly 60 is thus hingedly connected to one of the bolts of the two bolt and nut assemblies for limited swinging movement between the lowered locking position wherein it is illustrated in full lines in FIGS. 1, 2 and 4 of the drawings, and the raised position of release wherein it is illustrated in broken lines in FIG. 4.

The spreader bar 90 is preferably stamped from flat metal strip stock, is of angular configuration, and consists of a flat proximate attachment ear 94 at one end, a flat distal attachment ear 96 at its other end, inclined outwardly bowed medial sections 98, and a central U-shaped section 100. The proximate attachment ear 94 is provided with the hole 92 for the cylindrical section 88 of the associated bolt 80 while the distal attachment ear 96 is formed with a downwardly extending notch 104 which straddles the cylindrical section of the associated bolt 80 when the spreader bar is in its lowered locking position as shown in full lines in FIG. 4. The U-shaped bight portion 100 is provided therein with a downwardly extending central notch 110 which straddles the threaded section 54 of the adjacent she-bolt 50 when the spreader bar 90 is in its lowered locked position.

From the above description, it will be observed that the spreader bar 90 of the spreader bar assembly 60 is capable of swinging movement about the axis of the left-hand bolt 80 as viewed in FIGS. 1, 2 and 4, such swinging movement between the raised position in which it is shown in dotted lines in FIG. 4 and the lowered full-line position wherein the notch 110 in the bight portion 100 straddles and seats upon the threaded section 54 of the adjacent she-bolt 50 while the notch 104 in the distal attachment ear 96 straddles and seats upon the cylindrical portion 84 of the right-hand bolt 80 as viewed in FIGS. 1, 2 and 4. Appropriate clearances are maintained so that both of these notches may pass freely over the she-bolt 50 and said right-hand bolt 80 respectively without binding while the depth of the notches is sufficiently great that the gravitational force acting on the spreader bar 90 may be relied upon to maintain the bar seated in its locked position.

In the operation of the herein described spreader bar assembly 60, wall form erection is made in the usual manner by setting up the two form sides 12 and 14, first applying the strongbacks 24 thereto in their vertical positions as shown in FIGS. 1 and 2, then causing the tie rods 42 and their associated she-bolts 50 to bridge the concrete wall form 10 so that the she-bolts pass through the openings or holes 58 in the plywood facings 18 of the panel units 16 and also pass between the channel members of the adjacent strongbacks 24, and thereafter slipping the circular washers 62 over the outer externally-threaded sections of the she-bolts 50 so that they bear against the outer side flanges 28 of the channel members of the strongbacks. At this time, the spreader bar 90 of each assembly 60 is applied to the flanges 28 of the channel members of the adjacent strongbacks 24 by causing the flanges 28 to be clamped between the shoulders 82 on the bolts 80 and the nuts 86 as previously indicated, the left-hand bolt 80 as viewed in FIGS. 1, 2 and 4 being first passed through the hole 102 in the proximate ear 94 of the spreader bar. Utilizing a suitable torque wrench, the she-bolts 50 may then be adjusted to bring the form sides 12 and 14 to their true vertical positions, after which the spreader bars 90 will then be swung to their lowered locking positions wherein the heads of the bolts 80 will react against the locking bar ears 94 and 96 to prevent inward movement of the strongbacks 24, and consequently, the form sides 12 and 14, prior to pouring of the wet concrete between such sides. It will be apparent, therefore, that the cylindrical portions 88 of the bolts 80, together with their associated heads, constitute, in effect, headed studs which function in tension to absorb any inward reaction thrust which may be present when there is a tendency for the adjacent form side to shift inwardly prior to concrete-pouring operations.

From the above description, it will be apparent that the sole function of the herein described spreader bar assembly 60 is to hold the adjacent strongbacks erect during the time that the concrete is poured between the form sides.

When it is desired to dismantle the concrete wall form after the poured concrete has become set, it is a simple matter to swing each spreader bar 90 from the locked position shown in full lines in FIG. 4 to its unlocking dotted-line position, after which the she-bolts 50 may be turned out of connected relation with the concrete-embedded tie rods 42, the bolts 80 withdrawn and the remainder of the form dismantled in the usual manner of dismantling operations.

The invention is not to be limited to the exact arrangement of parts shown in the accompanying drawings or described in this specification as various changes in the details of construction may be resorted to without departing from the spirit or scope of the invention. Therefore, only insofar as the invention is particularly pointed out in the accompanying claims is the same to be limited.

I claim:

1. In combination with a wall form having opposed panels between which wet concrete is poured in the formation of the wall, said panels having a pair of aligned holes therein, a pair of upstanding, laterally spaced, channel-like strongbacks secured to the outer side of each panel and disposed on opposite sides of the hole therein, said strongbacks having outwardly extending flanges along their outer longitudinal edges, a she-bolt projecting through each of said holes, a tie rod extending across the form and threadedly connected at its ends to the inner ends of the she-bolts, a spreader bar assembly for maintaining each pair of strongbacks substantially erect during concrete-pouring operations, said spreader bar assembly comprising a reaction washer through which the associated she-bolt projects slidably, said washer bridging the distance between the strongbacks annd overhanging the outwardly extending flanges thereon on opposite sides of said she-bolt, a clamping nut threadedly received on the outer end of said she-bolt and engageable with the washer to prevent outward spreading of the adjacent panel during concrete-pouring operations, a pair of clamping blocks disposed rearwardly of and overhanging said outwardly extending flanges, headed studs projecting outwardly from said clamping blocks and passing loosely through openings in the overhanging portions of said reaction washer, and a spreader bar proper having one end thereof pivoted to one of said studs and having an open-ended notch formed in its other end, the medial region of said spreader bar being formed with a laterally offset section which likewise is provided with an open-ended notch, said spreader bar being capable of swinging movement into and out of an operative position wherein the notch in its other end straddles the other headed stud and said laterally offset section encompasses the clamping nut with its notch in straddled relation with the outer end of said she-bolt forwardly of said clamping nut.

2. The combination set forth in claim 1 and wherein the washer is generally of circular design, lies within the lateral confines of said outwardly extending flanges on the strongbacks, and is provided with a pair of diametrically-opposite radially and outwardly extending clamping ears which constitute the overhanging portions of the washer.

3. The combination set forth in claim 2 and wherein each clamping block is formed with a recess in its outer side which receives therein the outer edge portion of the associated outwardly extending flange on the adjacent strongback.

4. The combination set forth in claim 3 and wherein each of the headed studs is established by the provision of a shouldered bolt having a cylindrical shank portion which seats against its associated clamping block and projects forwardly therefrom, a reduced threaded shank portion which projects loosely through an opening in such clamping block, and a nut which is received on said threaded shank portion for drawing the cylindrical shank portion against the clamping block.

* * * * *